US010697668B2

(12) United States Patent
Kowald

(10) Patent No.: US 10,697,668 B2
(45) Date of Patent: Jun. 30, 2020

(54) FLUE BAFFLE

(71) Applicant: Lennox Industries Inc., Richardson, TX (US)

(72) Inventor: Glenn W. Kowald, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 395 days.

(21) Appl. No.: 15/457,267

(22) Filed: Mar. 13, 2017

(65) Prior Publication Data

US 2017/0241668 A1 Aug. 24, 2017

Related U.S. Application Data

(63) Continuation-in-part of application No. 15/047,243, filed on Feb. 18, 2016, now Pat. No. 10,544,961.

(51) Int. Cl.

| | |
|---|---|
| ***F24H 9/20*** | (2006.01) |
| ***F24H 3/08*** | (2006.01) |
| ***F24H 9/00*** | (2006.01) |
| ***F24H 9/18*** | (2006.01) |

(52) U.S. Cl.

CPC ..... *F24H 9/2085* (2013.01); *F24H 3/087* (2013.01); *F24H 9/0073* (2013.01); *F24H 9/1881* (2013.01)

(58) Field of Classification Search

CPC ..... F24H 9/1881; F24H 9/2085; F24H 3/087; F24H 9/0073

See application file for complete search history.

(56) References Cited

U.S. PATENT DOCUMENTS

| | | | | |
|---|---|---|---|---|
| 4,354,479 | A * | 10/1982 | Haruhara | F23C 3/00 126/92 AC |
| 6,938,688 | B2 | 9/2005 | Lengauer, Jr. et al. | |
| 8,209,971 | B2 * | 7/2012 | Kalantarifiroozabad | F01N 3/025 431/249 |
| 2009/0098496 | A1 | 4/2009 | Poirier | |
| 2010/0180368 | A1 | 7/2010 | West, Jr. | |
| 2013/0137052 | A1 | 5/2013 | Laskowski et al. | |
| 2013/0319347 | A1 | 12/2013 | Fioriti | |
| 2015/0192291 | A1 | 7/2015 | Akbarimonfared et al. | |
| 2015/0369495 | A1 * | 12/2015 | Maricic | F23D 14/045 126/116 A |

* cited by examiner

*Primary Examiner* — Grant Moubry
*Assistant Examiner* — Aaron H Heyamoto
(74) *Attorney, Agent, or Firm* — Hubbard Johnston, PLLC

(57) ABSTRACT

A flue shield and mesh baffle are described for use within HVAC systems and inside of a combustion chamber. The shield or baffle can be installed around the burner and within the combustion chamber to help dissipate heat that builds up as a result of the combustion of gas and air. An air gap is created between the flue shield and the inner surfaces of the combustion chamber and heat exchanger tubes. A mesh baffle can provide heat insulation and noise dampening. Installation of a flue shield or mesh baffle provides better efficiency than insulation solutions, reduces stresses on the heat exchanger, and provides safety benefits.

16 Claims, 8 Drawing Sheets

FLUE BAFFLE

CROSS REFERENCE TO RELATED INFORMATION

This application is a continuation-in-part of U.S. patent application Ser. No. 15/047,243, filed Feb. 18, 2016, titled Premix Burner Internal Flue Shield.

TECHNICAL FIELD

The present disclosure is directed to HVAC systems and more particularly to combustion chambers in low NOx heating systems.

BACKGROUND OF THE INVENTION

HVAC systems typically contain a heat exchanger system that houses combustion of a gas and air mixture. Typically, air and gas are mixed and ignited within a combustion chamber. Flames from the combustion heat the combustion chamber and may also extend out of the combustion chamber into heat exchanger tubes or clamshells. Air may be blown past the tubes or clamshells in order to be heated. The combustion creates high temperatures within the combustion chamber and the heat exchanger. The high temperatures can cause stresses on the burner and heat exchanger components. There can also be safety or fire risks when components are raised to such high temperatures.

In order to reduce pollutants some HVAC systems implement low nitrous oxide burners and heat exchangers. One typical low NOx system comprises a premixer and/or premix burner. These components mix gas and air prior to combustion in the combustion chamber. Such systems results in higher temperatures than normal systems, in some embodiments up to around 1300 F. With such high temperatures, combustion chambers and heat exchangers can be subject to great stresses, especially in regions between areas of differing temperatures. One solution in the prior art has been to add insulation within the burner. Insulation helps lower temperatures on the surface of HVAC components, but insulation can also direct the heat to different locations within a burner or heat exchanger, merely relocating problems to different locations. Some insulation can also be environmentally damaging.

BRIEF SUMMARY OF THE INVENTION

One embodiment of the present disclosure comprises a heat exchanger system comprising: a burner to receive a mixture of gas and air; a combustion chamber coupled to the burner and configured to house a combustion of the mixture of gas and air, the combustion chamber comprising one or more holes; a mesh baffle disposed on an interior surface of the combustion chamber and comprising one or more holes matching the one or more holes of the combustion chamber; and one or more heat exchanger inlets, each of the heat exchanger inlets configured to receive the combustion of the mixture through the one or more holes of the combustion chamber.

Another embodiment of the present disclosure comprises a baffle for a combustion chamber of a heat exchanger system comprising: a mesh configured to fit within the combustion chamber and to house a combustion of a gas and air mixture ignited within the combustion chamber, the mesh comprising one or more holes configured to line up with one or more holes in the combustion chamber, wherein the one or more holes in the combustion chamber are configured to direct the combusted gas and air mixture into one or more heat exchangers.

Another embodiment of the present disclosure comprises a method of operating a furnace in an HVAC system comprising: mixing gas and air together in a premix; receiving the gas and air mixture in a burner; igniting the gas and air mixture; housing the ignition of the gas and air mixture in a combustion chamber coupled to the burner, the combustion chamber comprising a plurality of holes and a mesh baffle on at least a portion of its inner surface; and receiving the combusted gas and air mixture in a plurality of heat exchanger tubes from the plurality of holes in the combustion chamber.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The present disclosure includes teachings directed to a flue shield or a mesh baffle for use inside a combustion chamber in a heat exchanger subsystem of an HVAC system. The flue shield or mesh baffle can help to dissipate heat, lower the surface temperature of system components, and to do so in a more efficient manner than prior art solutions such as insulation. Noise dampening can also be achieved. The flue shield or mesh baffle can be constructed of readily available materials and in some cases can be retrofitted to preexisting HVAC systems. Solutions under the present disclosure may be more environmentally friendly than the prior art.

Figure 1:
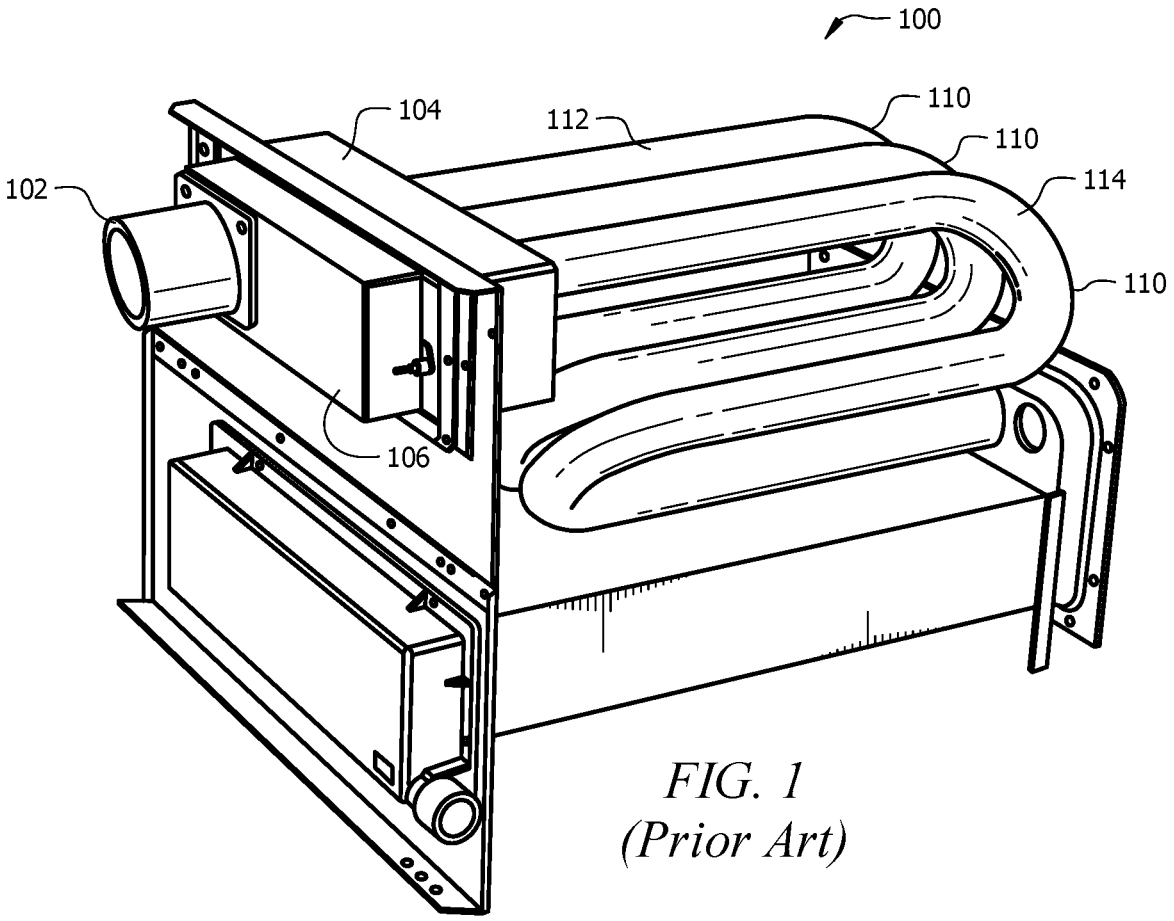
FIG. 1 (Prior Art)
FIG. 1 is a diagram of a prior art embodiment.

FIG. 1 shows an embodiment of a prior art burner and heat exchanger. Gas-air inlet 102 delivers a mix of gas and air to premix burner assembly 106. The mixture passes through burner assembly 106 into combustion chamber 104 where an igniter (not shown) can ignite the mixture. The combusted mix of gas, air, and particulates then passes into heat exchanger tubes 110. Temperatures within the combustion chamber 104 and heat exchanger tubes 110 (especially areas proximate 112 the combustion chamber 104) can reach 1300° F., or similar temperatures depending on the particular HVAC system. To help control temperatures within the system, a prior art solution for use with premix burners is to place insulation within the interior of the combustion chamber and/or heat exchanger tubes. The insulation can comprise various types, such as refractory ceramic fiber. The insulation is typically formed along the inside surface of the combustion chamber and thereby encases the combustion of any materials therein. Insulation can help to reduce temperatures in certain areas but can raise them in other areas. For instance, insulation within the combustion chamber 104 or area 112 proximate the combustion chamber 104 can cause the heat of the system to be redirected to less proximate area 114. As a result, any stresses that the high temperatures cause, will be directed at area 114 instead of area 112. But the heat exchanger tubes 110 still face high temperature stresses. Generally, the use of insulation results in reduced efficiency and excessive heat exchanger temperatures further down in the heat train. High temperature insulations are also expensive, difficult to handle, and have a current classification as a possible human carcinogen.

Figure 2:
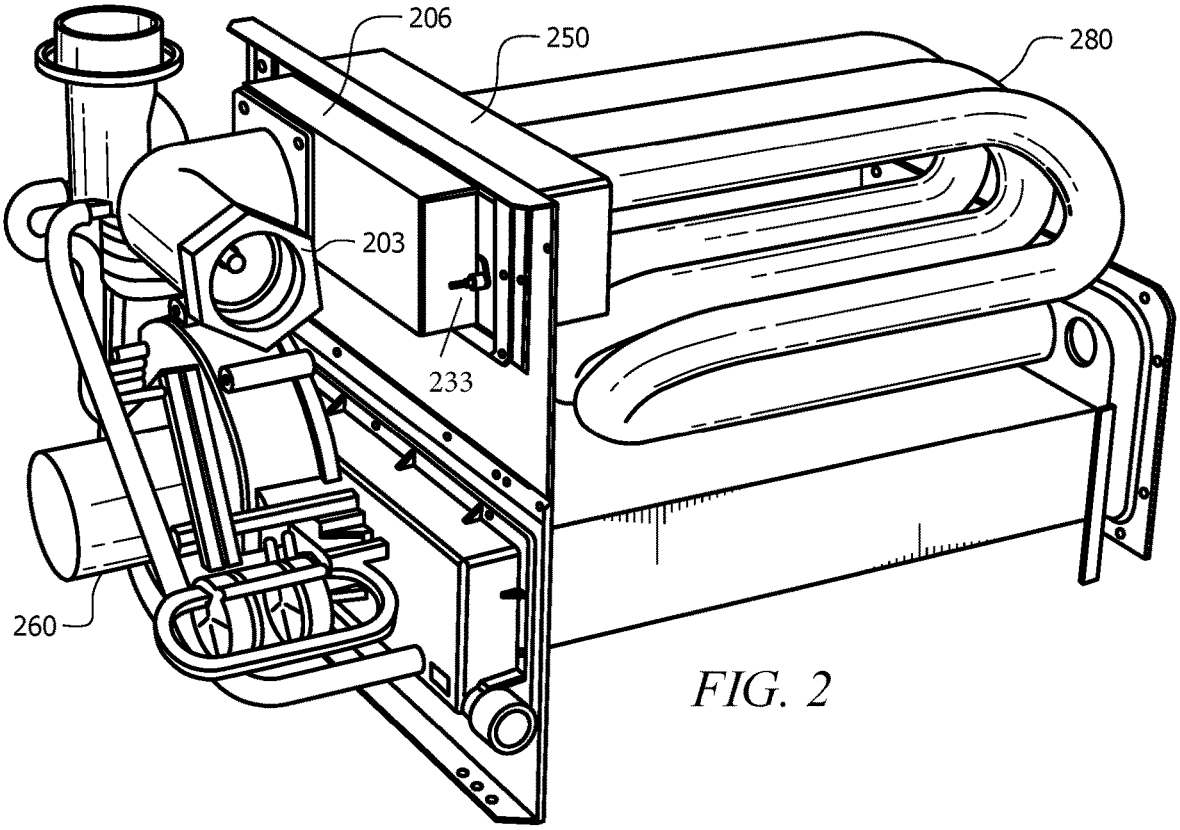
FIG. 2 is a diagram of a possible embodiment under the present disclosure.

FIG. 2 displays an embodiment of the interior of an HVAC cabinet under the present disclosure. Inlet 203 provides gas and air to a premix burner assembly 206. Combustion chamber 250 encloses an igniter and flue shield (not shown). Combustion within the combustion chamber 250 produces combusted material and flames which can reach into tubes 280. A blower 260 induces flow of combustion products through tubes 280 and through the remaining components in the heat exchanger. Other components can be similar to other heat exchangers and HVAC units well known in the art.

Figure 3:
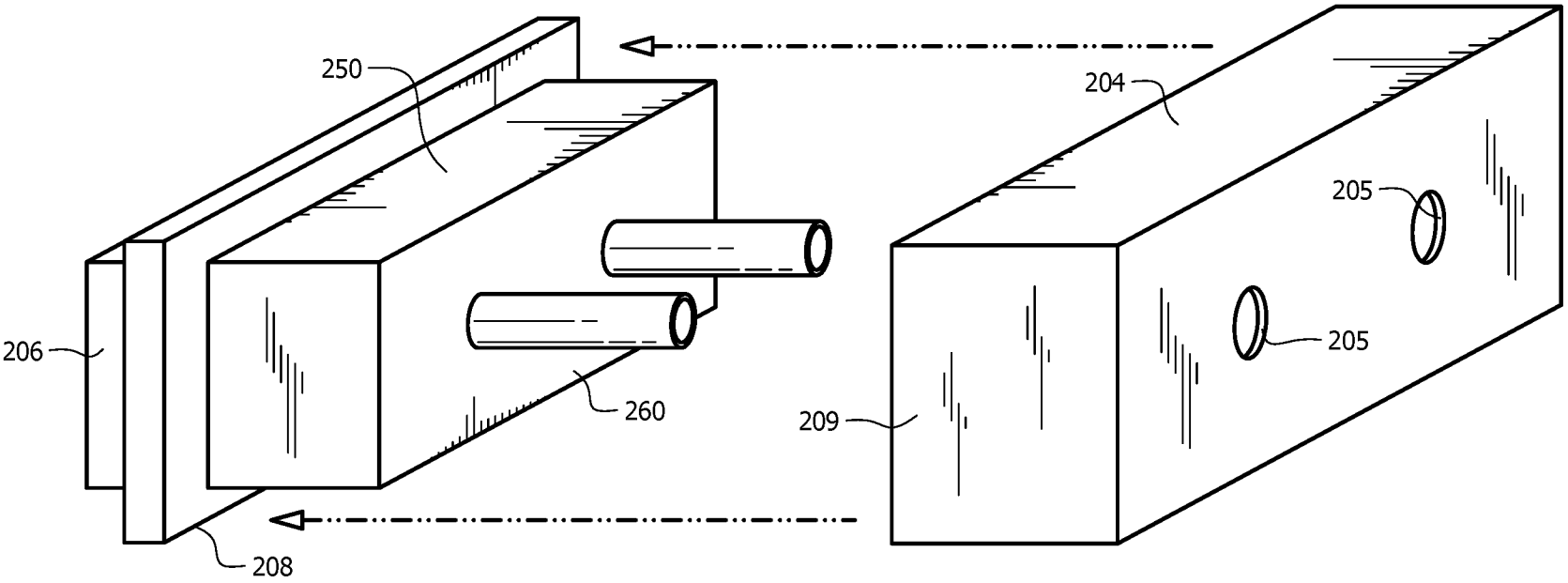
FIG. 3 is a diagram of a possible embodiment under the present disclosure.

FIG. 3 displays a more detailed view of a flue shield embodiment in FIG. 2 under the present disclosure. As shown, flue shield 250 can be installed inside a combustion chamber 204. Pre-mix burner 206 delivers air and gas to the interior of the flue shield 250 where an igniter (not shown) ignites the mixture. Flue shield 250 is placed beneath/inside the combustion chamber 204 so that the body 209 of combustion chamber 204 is flush against face 208. Flue shield extensions 260 extend through combustion chamber holes 205. Extensions 260 can then extend into heat exchanger tubes (not shown). Other embodiments may not utilize extensions 260. The dimensions of the flue shield 250, combustion chamber 204, and flue shield extensions 260 should be such as to leave an air gap between combustion chamber 204 and flue shield 250. There can also be an air gap between the surface of the extensions 260 and the inner surface of a heat exchanger. The dimensions of the air gaps can be chosen depending on the particular embodiment. Some embodiments may use almost an interference fit in various parts of the system, such as the extensions 260, or some embodiments may use a larger air space between the various components. The application of a flue shield not only solves the problem of excessive temperatures but also continues to provide radiant and convective heat transfer. This helps maintain efficiency and cools flue gases to the point where heat exchanger temperatures are manageable downstream of the internal shielding. The internal flue shielding can be manufactured with conventional material and methods and eliminates the use of potentially hazardous materials. Flue shield 250 and combustion chamber 204 can attach to face 208 in any manner appropriate including welding, soldering, nuts, screws, or other means.

Figure 4:
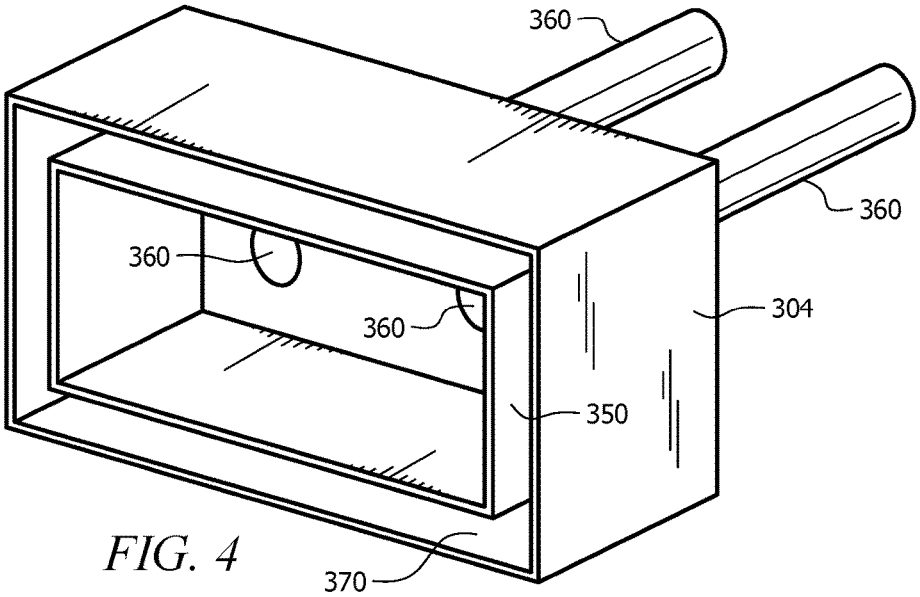
FIG. 4 is a diagram of a possible embodiment under the present disclosure.

FIG. 4 depicts another view of an embodiment of a flue shield under the current disclosure. In this view the burner-facing side of flue shield 350 and combustion chamber 304 are seen. Flue shield extensions 360 extend into combustion chamber holes 305 toward heat exchanger tubes (not shown). As can be seen, when installed, the flue shield 350 creates an air gap 370 between itself and the edges of the combustion chamber 304. The embodiment shown helps to lower the surface temperature of the combustion chamber 304 and of the heat exchanger tubes.

Figure 5:
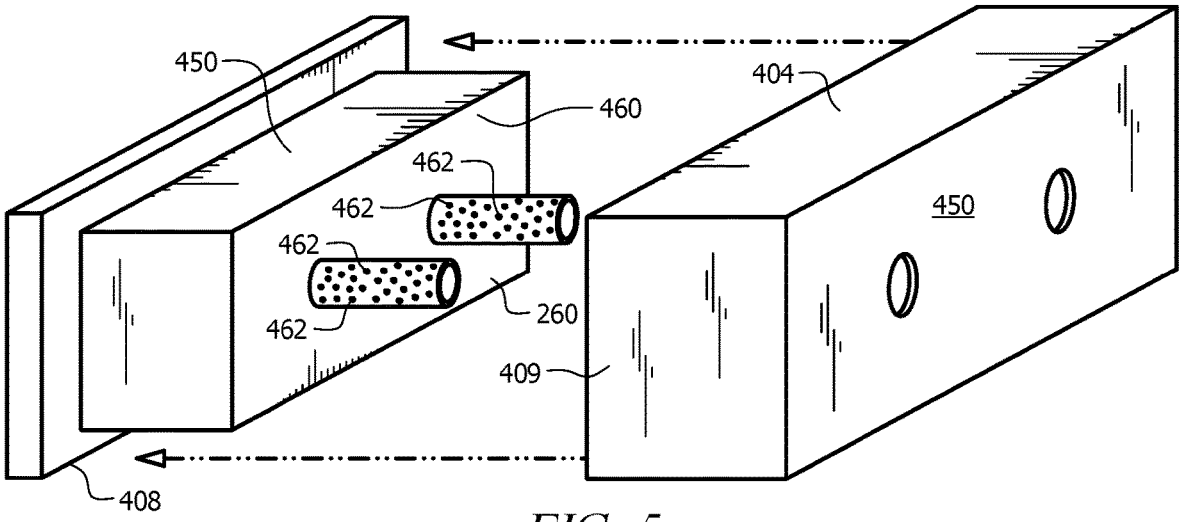
FIG. 5 is a diagram of a possible embodiment under the present disclosure.

FIG. 5 shows an embodiment wherein the flue shield extensions comprise a plurality of holes along their length. As shown, flue shield 450 attaches to a burner surface 408. Flue shield extensions 460 are attached to the flue shield 450 and comprise a plurality of holes 462. Holes 462 can allow for cooling of the combusted material and flame from the burner along a length of extensions 462. In other embodiments, such as FIG. 3, the hot temperature of the combusted material and flame may only escape the extensions 260 at the open end. In the embodiment of FIG. 4, heat may be dispersed along the entire length of extensions 462. Flue shield 450 and flue shield extensions 460 can be covered by combustion chamber 404 and chamber holes 405.

Figure 6:
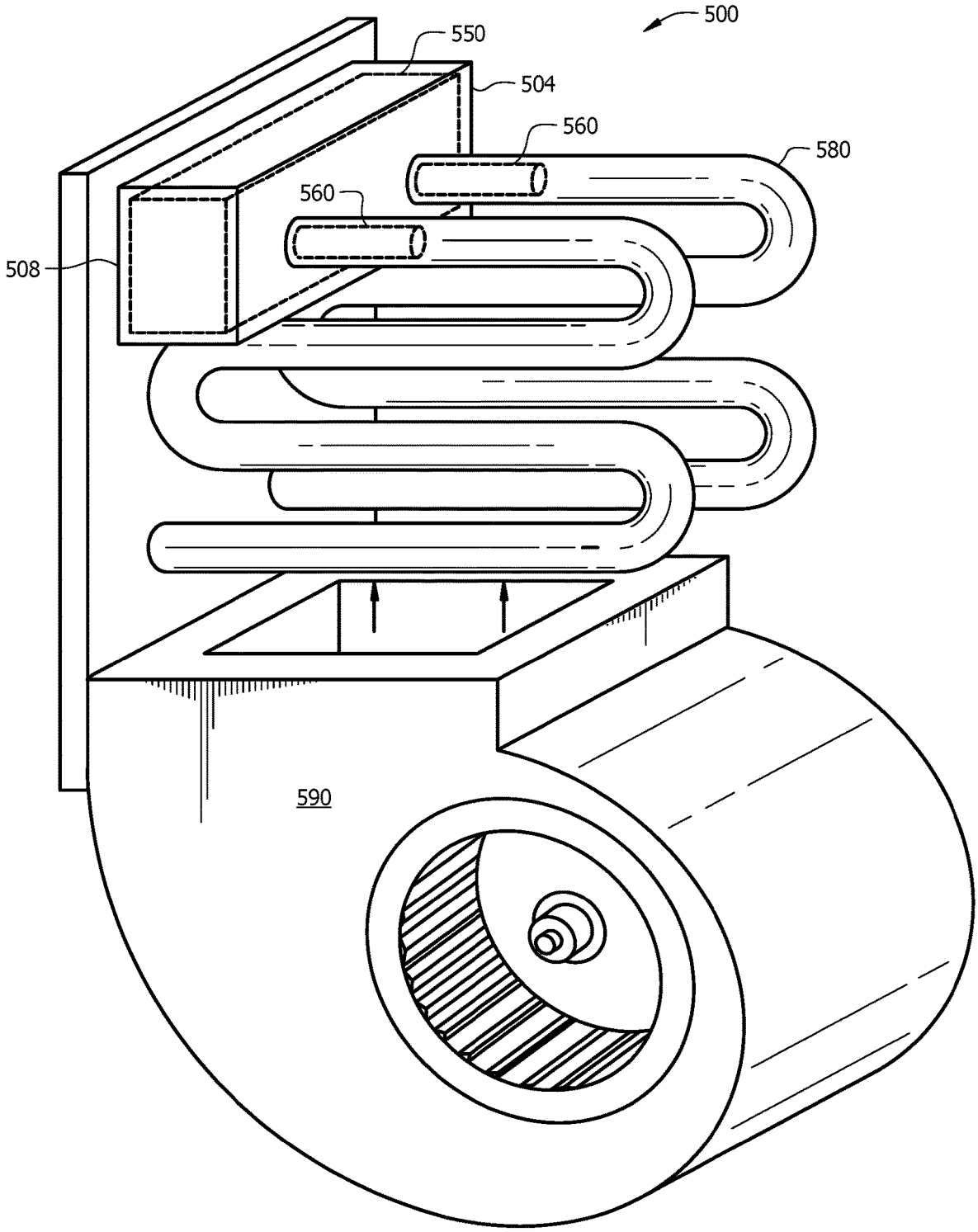
FIG. 6 is a diagram of a possible embodiment under the present disclosure.

FIG. 6 displays another possible embodiment of an HVAC system and heat exchanger 500 under the present disclosure. Flue shield 550 attaches to face 508 and fits within combustion chamber 504 (also attached to face 508). Flue shield extensions 560 extend through holes in the combustion chamber and into heat exchanger tubes 580. A blower 590 can sit below the tubes 580. In this embodiment tubes are shown in the heat exchanger 500. However, other embodiments can use clamshells or other types of heat exchanger tubes or geometries.

Figure 7:
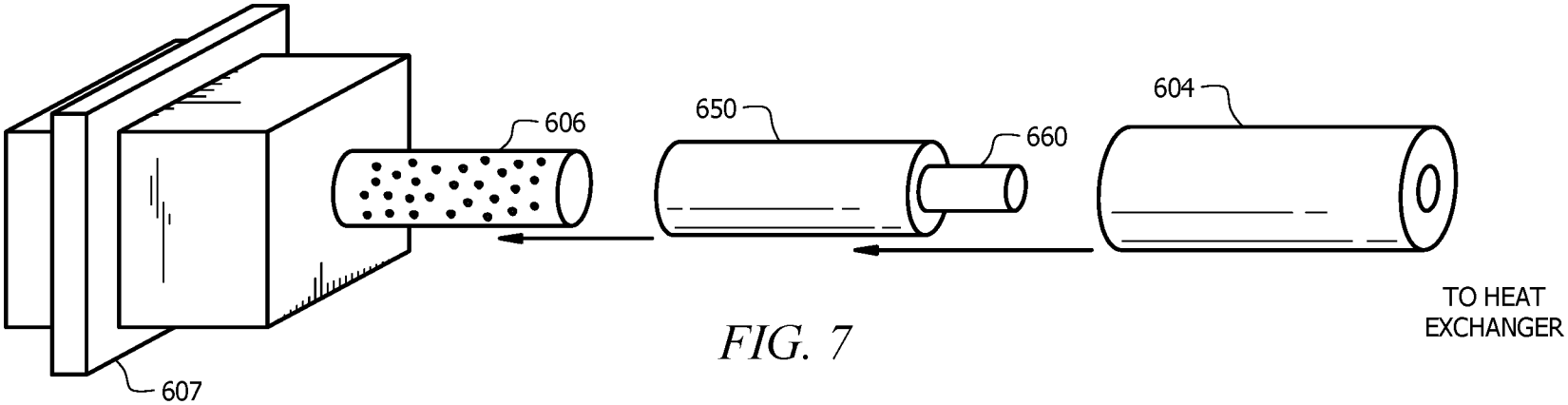
FIG. 7 is a diagram of a possible embodiment under the present disclosure.

The geometries and shapes of a burner, heat exchanger and flue shield can vary depending on a user's desires or wishes. FIG. 7, for example, displays an embodiment of the present disclosure in a setup with a cylinder burner 606. In such an embodiment, flue shield 650 can take a cylinder shape. Other components, such as a premix 607 can be similar to other embodiments. The flue shield 650 of this embodiment can work by the same principles of other differently shaped embodiments. An air gap created between the flue shield 650 and the combustion chamber 604 helps to contain the high temperatures within the flue shield 650 and prevents the exterior of the combustion chamber 604 and other components from being overheated. Flue shield extension 660 extends through combustion chamber hole 605, and can then extend into a heat exchanger.

Figure 8:
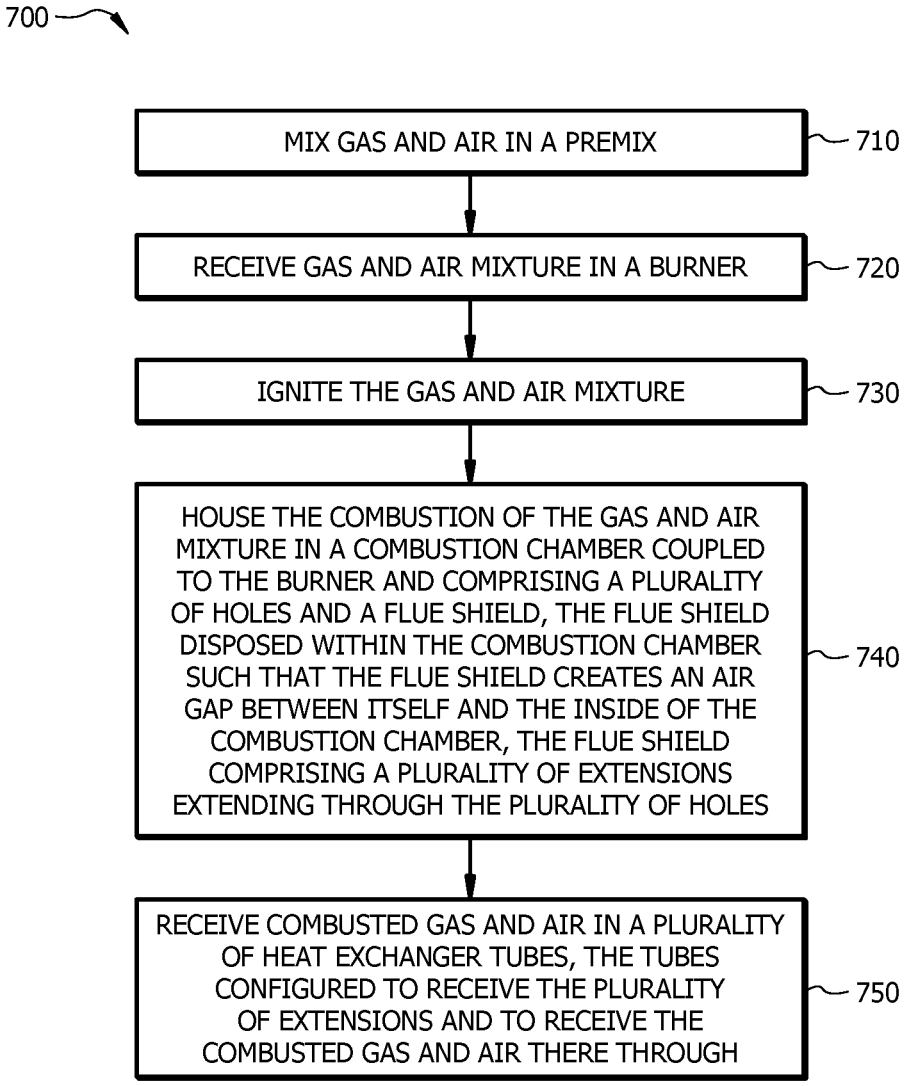
FIG. 8 is a flow-chart diagram of a possible method embodiment under the present disclosure.

FIG. 8 displays a possible method embodiment 700 under the present disclosure. At step 710 a gas and air mixture is received at a premix. At step 720 the gas and air mixture is received at a burner. At step 730 the gas and air mixture is ignited. At step 740 the combustion of the gas and air mixture is housed in a combustion chamber coupled to the burner and comprising a plurality of holes and comprising a flue shield, the flue shield disposed within the combustion chamber such that the flue shield housed the combustion and creates an air gap between itself and the inside of the combustion chamber, the flue shield comprising a plurality of extensions extending through the plurality of holes. At 750 the combusted gas and air in a plurality of heat exchanger tubes, the tubes configured to receive the plurality of extensions and to receive the combusted gas and air therethrough.

Embodiments of a flue shield as described herein can comprise a variety of materials. In a preferred embodiment a flue shield is made of stainless steel. Different stainless steels can be used such as 400 series, 300 series or other alloys of chromium, nickel and other metals as appropriate. Some embodiments may be able to use ceramics. A typical embodiment of a flue shield may have to withstand temperatures up to 1300° F. Some ceramics can be made to withstand such temperatures or higher and may be appropriate for certain flue shield embodiments.

Experiments performed using a flue shield as described herein has shown that a flue shield can cause a drop in external temperature of the combustion chamber and heat exchanger tubes from roughly 1300° F. to 1100° F. in components of a heat exchanger and combustion chamber. Other embodiments have produced similar results. A temperature drop of approximately 15-20% is commonly seen. However, embodiments can produce greater or less temperature difference depending on various factors such as size, geometry, type of burner, materials used and other factors.

Common manufacturing processes can be used to create flue shields according to the present disclosure. Welding can attach extensions onto a flue shield and welding can also attach flue shields to burners and other components. Bolts and other physical attachment means can also be used. Various manufacturing processes for stainless steel and other metals, well known in the art, can be used to create flue shields. If a flue shield is comprised of ceramic then ceramic manufacturing processes will have to be used. Various attachment means such as bolts, screws, sealants and other means can be used when attaching ceramic flue shields to other components. Ceramic flue shields will likely have to be created in one piece comprising both extensions and the flue shield body. Metal flue shields can be manufactured of separate pieces—body and extensions. The body and extensions can then be welded or soldered together or connected by other means.

Figure 9:
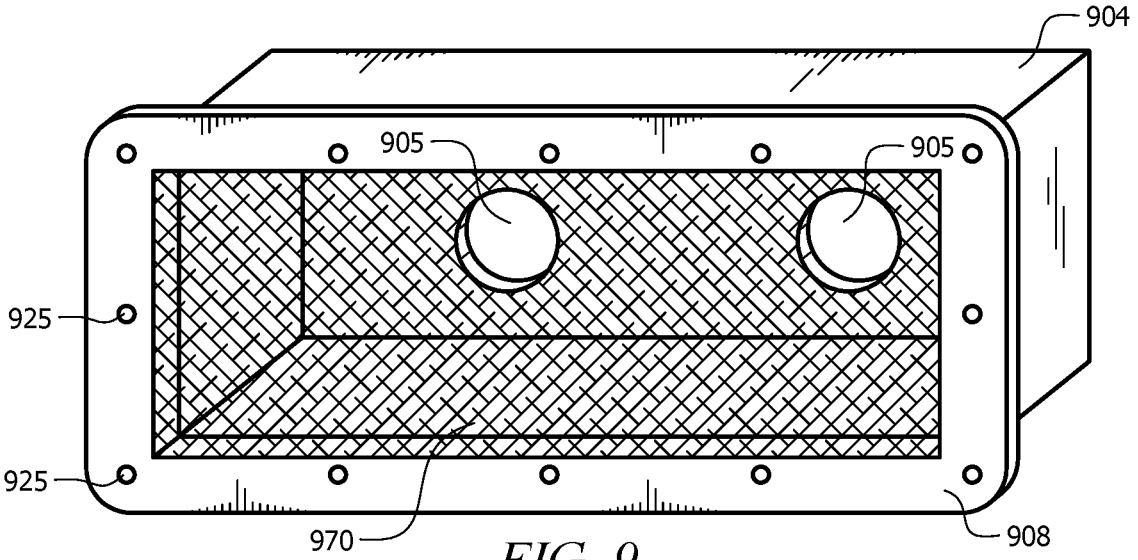
FIG. 9 is a diagram of a possible embodiment under the present disclosure.

An additional possible embodiment of the present disclosure can comprise a metallic fiber mesh flue baffle within a combustion chamber. Such an embodiment can be seen in FIG. 9. A mesh baffle 970 can be disposed on the interior surface of a combustion chamber 904. Chamber 904 can comprise chamber holes 905, attachment face 908, and attachment holes 925. Holes 925 can be used to attach to a burner box, premix burner, or other components. Mesh 970 can comprise a mesh of varying thickness according to a user's needs. Mesh 970 can be applied or attached to the interior surface of chamber 904. Attachment can be done by spot welding, brazing, or other appropriate means. In a preferred embodiment, the metallic fiber mesh 970 comprises an iron-chromium-aluminum (FeCrAl) alloy. Other embodiments can comprise other materials. In most embodiments a high temperature alloy will be desired. For example, it may be desired to use an alloy capable of withstanding temperatures up to roughly 1300° F. Various embodiments may utilize alloys able to withstand greater or lesser temperatures.

Like the flue shield of other embodiments, the mesh baffle 970 helps to lessen the problem of excessive temperature in the combustion chamber and in downstream heat exchanger tubes. One benefit of the mesh construction is that radiant and convective heat transfer can still occur. Additionally, mesh baffle 970 can provide dampening of combustion resonance or noise because of its uneven surface which disrupts the reflection of sound waves.

Mesh 970 can be applied throughout the whole interior surface of chamber 904. Other embodiments can comprise only partial covering. In some embodiments, mesh 970 can extend through combustion chamber holes 905 and/or into heat exchanger tubes, clam shells, or other components. Mesh 970 can be applied when manufacturing a combustion chamber and can also be part of a retrofit installation.

Figure 10:
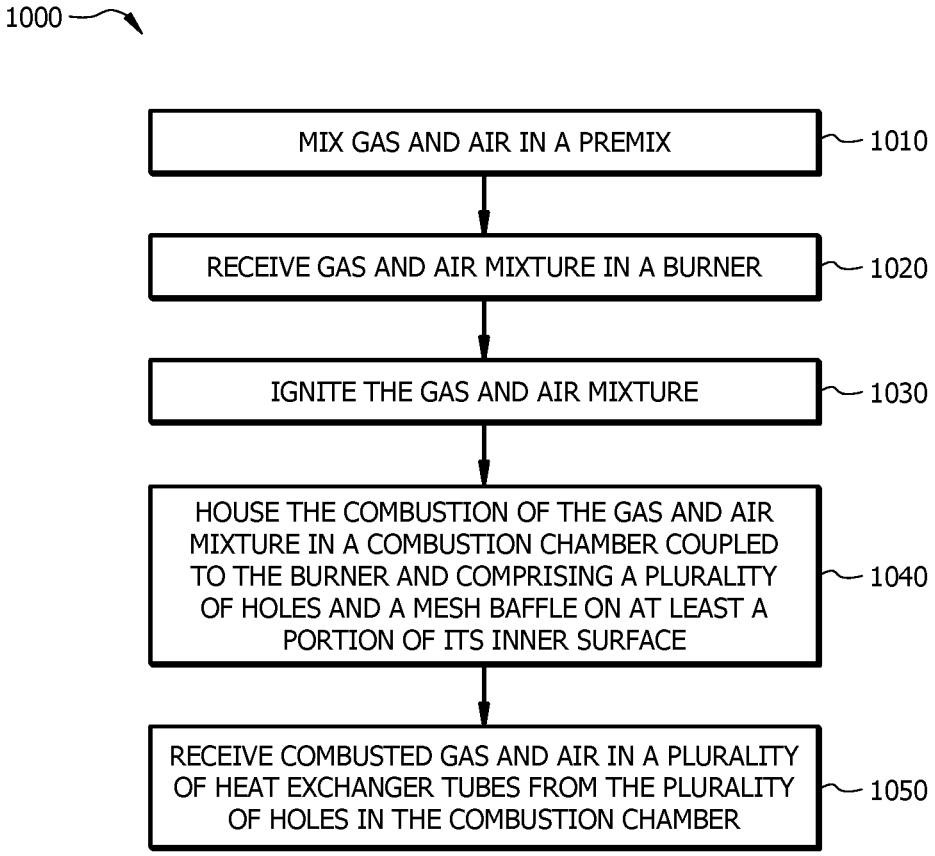
FIG. 10 is a flow-chart diagram of a possible method embodiment under the present disclosure.

FIG. 10 displays a possible method embodiment 1000 under the present disclosure. At step 1010, gas and air are mixed in a premix. At 1020 the gas and air mixture are received in a burner. At 1030 the gas and air mixture is ignited. At 1040 the combustion of the gas and air mixture is housed in a combustion chamber coupled to the burner and comprising a plurality of holes and a mesh baffle on at least a portion of its inner surface. At 1050 the combusted gas and air is received in a plurality of heat exchanger tubes form the plurality of holes in the combustion chamber.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A heat exchanger system comprising:

a burner to receive a mixture of gas and air;

a combustion chamber coupled to the burner and configured to house a combustion of the mixture of gas and air, the combustion chamber comprising an exterior wall formed with one or more chamber holes through a downstream portion of the exterior wall, wherein the downstream portion of the exterior wall is downstream of where the mixture of gas and air enters the combustion chamber;

a mesh baffle disposed on an interior surface of the downstream portion of the exterior wall of the combustion chamber and the mesh baffle comprising one or more holes matching the one or more chamber holes of the combustion chamber; and a heat exchanger having one or more heat exchanger inlets, each of the heat exchanger inlets configured to receive the combustion of the mixture through the one or more holes of the combustion chamber.

2. The heat exchanger system of claim 1 wherein the mesh baffle comprises an iron-chromium-aluminum alloy.

3. The heat exchanger system of claim 1 wherein the heat exchanger comprises a cylinder-shaped burner.

4. The heat exchanger system of claim 1 wherein the mesh baffle comprises an iron alloy.

5. The heat exchanger system of claim 1 wherein the mesh baffle comprises an alloy able to withstand temperatures up to 1300.degree. F.

6. The heat exchanger system of claim 1 wherein the plurality of heat exchanger inlets comprise a plurality of clamshell heat exchangers.

7. The heat exchanger system of claim 1 further comprising a blower.

8. The heat exchanger system of claim 1 wherein the combustion chamber comprises a plurality of attachment mechanisms for coupling the combustion chamber to the burner.

9. A heat exchanger system comprising:

a burner to receive a mixture of gas and air;

a combustion chamber coupled to the burner and configured to house a combustion of the mixture of gas and air, the combustion chamber comprising an interior and having one or more holes through an exterior wall of the combustion chamber;

a mesh baffle disposed on an inner surface of the exterior wall of the combustion chamber and comprising one or more holes matching the one or more holes of the combustion chamber;

one or more heat exchanger inlets, each of the heat exchanger inlets configured to receive the combustion of the mixture through the one or more holes of the combustion chamber; and a flue shield disposed within an interior of the combustion chamber, the flue shield comprising:

a flue shield body comprising a flue shield wall formed with one or more holes, wherein the flue shield body is sized and configured to fit within the combustion chamber with an air gap formed between the inner surface of the exterior wall of the combustion chamber and an exterior of the flue shield wall.

10. The heat exchanger system of claim 9, wherein the mesh baffle comprises an iron-chromium-aluminum alloy.

11. The heat exchanger system of claim 9, wherein the heat exchanger comprises a cylinder-shaped burner.

12. The heat exchanger system of claim 9, wherein the mesh baffle comprises an iron alloy.

13. The heat exchanger system of claim 9, wherein the mesh baffle comprises an alloy able to withstand temperatures up to 1300.degree. F.

14. The heat exchanger system of claim 9, wherein the plurality of heat exchanger inlets comprise a plurality of clamshell heat exchangers.

15. The heat exchanger system of claim 9, further comprising a blower.

16. The heat exchanger system of claim 9, wherein the combustion chamber comprises a plurality of attachment mechanisms for coupling the combustion chamber to the burner.

* * * * *